US007479022B2

(12) United States Patent
Lee et al.

(10) Patent No.: US 7,479,022 B2
(45) Date of Patent: Jan. 20, 2009

(54) CONNECTOR WITH A LEVER TO COUPLE A CAP TO A PLUG

(75) Inventors: Chul-Sub Lee, Daegu (KR); Chang-Ho Lee, Kyungsan-Si (KR)

(73) Assignee: Tyco Electronics AMP Korea Ltd., Kyungsangbuk-do (KR)

( * ) Notice: Subject to any disclaimer, the term of this patent is extended or adjusted under 35 U.S.C. 154(b) by 0 days.

(21) Appl. No.: 11/861,579

(22) Filed: Sep. 26, 2007

(65) Prior Publication Data

US 2008/0076286 A1 Mar. 27, 2008

(30) Foreign Application Priority Data

Sep. 27, 2006 (KR) ..... 10-2006-0094213

(51) Int. Cl.
*H01R 13/62* (2006.01)

(52) U.S. Cl. ..... 439/157

(58) Field of Classification Search ..... 439/157, 439/266, 372, 152, 153
See application file for complete search history.

(56) References Cited

U.S. PATENT DOCUMENTS

| | | | | |
|---|---|---|---|---|
| 4,875,873 | A * | 10/1989 | Ishizuka et al. | 439/347 |
| 5,244,400 | A * | 9/1993 | Hatagishi | 439/157 |
| 5,681,175 | A * | 10/1997 | Busse et al. | 439/157 |
| 6,086,392 | A * | 7/2000 | Okabe | 439/157 |
| 6,155,850 | A * | 12/2000 | Martin et al. | 439/157 |
| 6,176,713 | B1 * | 1/2001 | Okabe | 439/157 |
| 6,217,354 | B1 * | 4/2001 | Fencl et al. | 439/157 |
| 6,319,050 | B1 * | 11/2001 | Miyazaki et al. | 439/489 |
| 6,354,852 | B2 * | 3/2002 | Noro et al. | 439/157 |
| 6,382,992 | B1 * | 5/2002 | Bouchan et al. | 439/157 |
| 6,592,384 | B2 * | 7/2003 | Sawayanagi | 439/157 |
| 6,699,051 | B2 * | 3/2004 | Hofmeister et al. | 439/157 |

* cited by examiner

*Primary Examiner*—Chandrika Prasad
(74) *Attorney, Agent, or Firm*—Barley Snyder LLC

(57) ABSTRACT

A connector includes a cap detachably coupled to a plug in a coupling direction. The cap and the plug being electrically connected to each other. A lever is coupled to the plug. The lever is moveable linearly in a direction the same as the coupling direction. A coupling is actuated by the linear movement of the lever. The coupling draws and compulsorily presses the cap into the plug in the coupling direction to couple the cap and the plug.

15 Claims, 9 Drawing Sheets

CONNECTOR WITH A LEVER TO COUPLE A CAP TO A PLUG

CROSS-REFERENCE TO RELATED APPLICATIONS

This application claims the benefit of the filing date under 35 U.S.C. § 119(a)-(d) of Korea Patent Application No. 10-2006-0094213, filed Sep. 27, 2006.

FIELD OF THE INVENTION

The present invention relates to a connector, and more particularly to a connector having a detachable plug and cap wherein a lever draws the cap into the plug when the lever is movable linearly in a direction the same as a coupling direction of the plug and the cap.

BACKGROUND

Generally, a connector serves to electrically connect respective parts in a circuit. The connector is widely used to supply power to various machines and electronic products or connect various electrical operation signals. The connector, which is capable of being detached, includes a cap and a plug coupled to each other. A user holds the cap and the plug with both hands, respectively. Then, the cap and the plug are contacted and coupled by applying a large force in the opposite direction. Accordingly, there is a problem in that it is difficult to couple the cap and the plug in a small operation space.

In order to solve this problem, a connector has been developed that has a rotatable, hinged lever coupled at one side of the plug or the cap. The lever compulsorily couples the cap and the plug. However, since a rotational radius is needed to operate the lever, it is difficult to operate the lever in a small operation space.

SUMMARY

It is therefore an object of the present invention to provide a connector capable of easily and conveniently coupling a cap and a plug by moving a lever in a coupling direction of the connector with a small force.

Further, it is another object of the present invention to firmly couple the lever and the plug by a smooth sliding operation.

Further, it is yet another object of the present invention to connect the cap to the plug as the cap is compulsorily moved while the lever moves linearly in the plug by a simple configuration.

Further, it is yet another object of the present invention to prevent the separation of the cap and the plug in a coupling state.

Further, it is yet another object of the present invention to check the coupling and separation state of the cap and the plug by a feeling of the lever.

Further, it is yet another object of the present invention to prevent the pins from being rotated sideward at the inner side of the drawing grooves, the guide holes, and the operation holes.

Further, it is yet another object of the present invention to prevent the lever from being in close contact with the sliding grooves.

This and other objects are achieved by a connector comprising a cap detachably coupled to a plug in a coupling direction. The cap and the plug being electrically connected to each other. A lever is coupled to the plug. The lever is moveable linearly in a direction the same as the coupling direction. A coupling is actuated by the linear movement of the lever. The coupling draws and compulsorily presses the cap into the plug in the coupling direction to couple the cap and the plug.

DETAILED DESCRIPTION OF THE EMBODIMENT(S)

Figure 1:
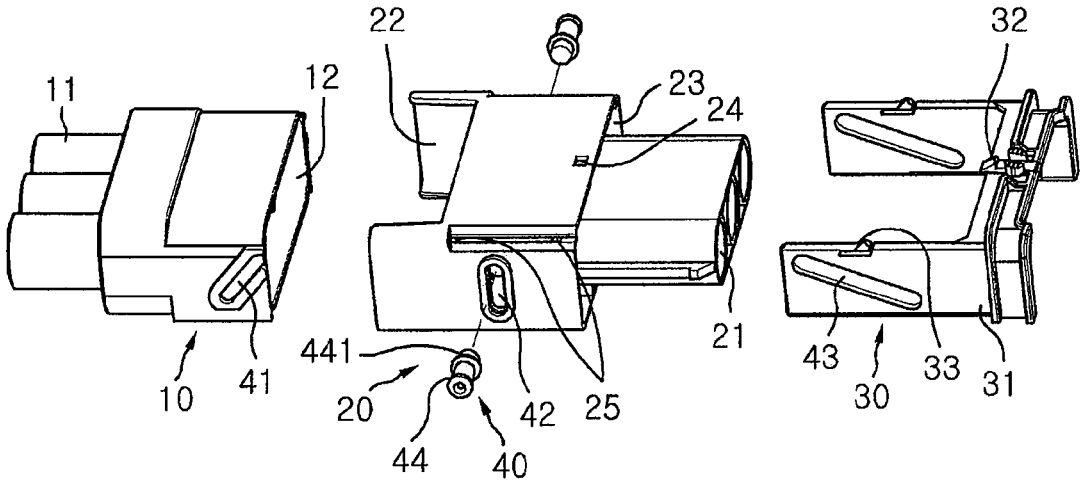
FIG. 1 is an exploded perspective view of a connector according to a first embodiment of the present invention.
Figure 2:
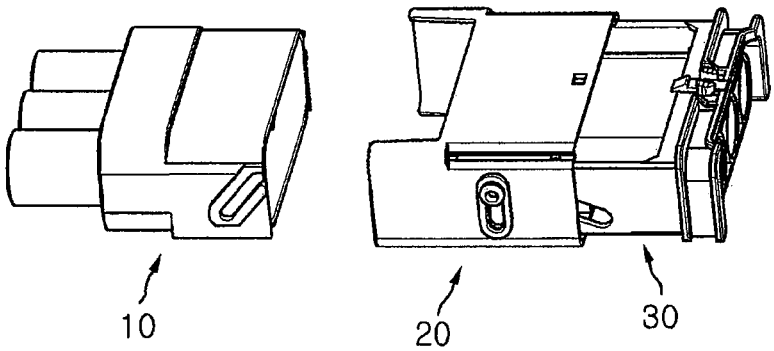
FIG. 2 is a partially exploded perspective view of the connector of FIG. 1 showing a primary assembly state.
Figure 3:
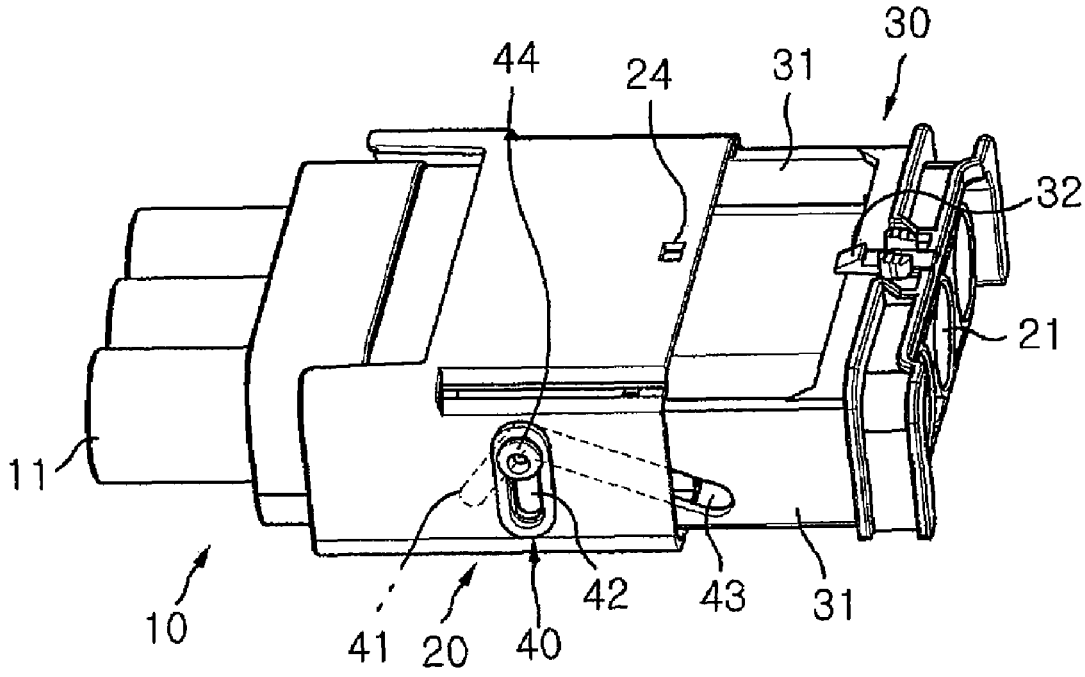
FIG. 3 is a perspective view of the connector of FIG. 1 showing a coupling state.

FIGS. 1-5*b* show a connector according to a first embodiment of the present invention. As shown in FIG. 1, the connector includes a cap 10, a plug 20, a lever 30, and a coupling 40. The cap 10 and the plug 20 are engaged and coupled to each other forming an electrical connection there between. The lever 30 moves substantially linearly in substantially the same direction as a coupling direction of the cap 10 and the plug 20. The coupling 40 causes the cap 10 to be compulsorily pressed and inserted into the plug 20 by the movement of the lever 30 such that the cap 10 and the plug 20 are simply and easily coupled and separated.

The individual elements of the connector will now be described in greater detail. As shown in FIG. 1, the cap 10 includes a wire connecting port 11 disposed at one side of the cap 10 configured to receive a plurality of wires (not shown) and a plug connection port 12 disposed at an opposite side of the cap 10 configured to be engaged with the plug 20. A terminal (not shown) is disposed inside the cap 10 and is configured to be connected to the wires (not shown) and coupled to the plug 20 to be connected to the power source. The terminal (not shown) may be made, for example, from metal.

The plug 10 includes a plug pin (not shown) disposed inside the plug 20 that is configured to be in contact with the terminal (not shown) to be connected to the power source. The plug pin (not shown) may be made, for example, from metal. The plug 10 has a lever receiving end 21 and a cap receiving end 22. Sliding grooves 23 are formed at opposite sides of the plug 20. The plug 20 has an engaging groove 24 formed on a surface thereof. Click grooves 25 are formed at an inner side of the sliding grooves 23 and are configured to be depressed corresponding to positions at which the lever 30 is inserted and separated at a maximum level.

The lever 30 is coupled to one side of the plug 20 and linearly moves in substantially the same direction as a coupling direction of the cap 10 and the plug 20 such that the cap 10 and the plug 20 are compulsorily coupled or separated by the operation of a user. Lever operation pieces 31 are formed at one side of the lever 30. The lever operation pieces 31 are configured to be inserted into the sliding grooves 23 formed at opposite sides of the plug 20 to pass through the plug 20 and move along the sliding grooves 23. The other side of the lever 30 is exposed to the outside of the plug 20 such that the user can easily move the lever 30. An engaging projection 32 corresponding to the engaging groove 24 is formed on a surface of the lever 30. Click protrusions 33 capable of being elastically moved up and down are formed on outer surfaces of the lever operation pieces 31 at positions corresponding to the click grooves 25. As shown in FIG. 5*b*, separation protrusions 34 are formed on the outer surfaces of the lever operation pieces 31 along a moving direction of the lever 30.

As shown in FIG. 1, the coupling 40 causes the cap 10 to be compulsorily pressed and inserted into the plug 20 or performs an operation for pushing the cap 10 from the plug 20 by the forward and backward movement of the lever 30. The coupling 40 includes drawing grooves 41 formed at opposite sides of the cap 10, guide holes 42 formed at opposite sides of the plug 20, operation holes 43 formed at opposite sides of the lever 30, and pins 44 coupled to the drawing grooves 41, the guide holes 42, and the operation holes 43 by passing through all of them. Anti-rotation protrusions 441 are formed on outer surfaces of the pins 44.

The drawing grooves 41 are formed to be depressed on opposite side surfaces of the cap 10 and are formed to be open toward the plug connection port 12 of the cap 10. The drawing grooves 41 are also formed substantially obliquely downward toward the wire connecting port 11 of the cap 10. As the cap 10 is inserted into the plug 20, inner ends of the pins 44 are inserted into the drawing grooves 41, and the cap 10 is compulsorily coupled to the plug 20 by the movement of the lever 30.

The guide holes 42 are formed on an outer surface of the plug 20 to communicate with the sliding grooves 23. The guide holes 42 are formed into a hole extending substantially perpendicularly to the coupling direction of the connector. The guide holes 42 are configured such that the pins 44 can move in up and down directions along the guide holes 42 in a state where the pins 44 are inserted into the guide holes 42.

The operation holes 43 are formed on the lever operation pieces 31 of the lever 30 to pass there through. The operation holes 43 are formed substantially obliquely downward from the plug connection port 12 toward the wire connecting port 11. The operation holes 43 are configured such that the pins 44 can move in up and down directions along the operation holes 43 in a state where the pins 44 are inserted into the operation holes 43.

The pins 44 are inserted into the guide holes 42 and the operation holes 43 in a state where the guide holes 42 correspond to the operation holes 43 to couple the plug 20 and the lever 30 as one body. The pins 44 move in the up and down directions of the plug 20 by the movement of the lever 30 to allow the cap 10 to be inserted into the plug 20 or separated from the plug 20. The inner ends of the pins 44 are exposed to the inner side of the plug 20 to be inserted into the drawing grooves 41 through openings formed at leading ends of the drawing grooves 41.

The engaging groove 24 and the engaging projection 32 are respectively formed on corresponding surfaces of the plug 20 and the lever 30 such that the lever 30 is engaged and fixed to the plug 20 in a state where the cap 10 is entirely coupled to the plug 20. Accordingly, the cap 10 and the plug 20 coupled to each other can be prevented from being separated by the movement of the lever 30 due to external vibration. The engaging projection 32 may be formed to be movable in a substantially vertical direction in order to easily separate the engaging projection 32 from the engaging groove 24 when the cap 10 and the plug 20 are separated from each other and facilitate the recombination thereof. Additionally, when the click protrusions 33 are inserted into the click grooves 25 at the maximum insertion and separation positions of the lever 30, the user realizes a feeling of clicking, whereby the user can confirm the complete coupling and separation of the connector in a small or dark space where it is difficult to check the state with the naked eye.

Figure 4A:
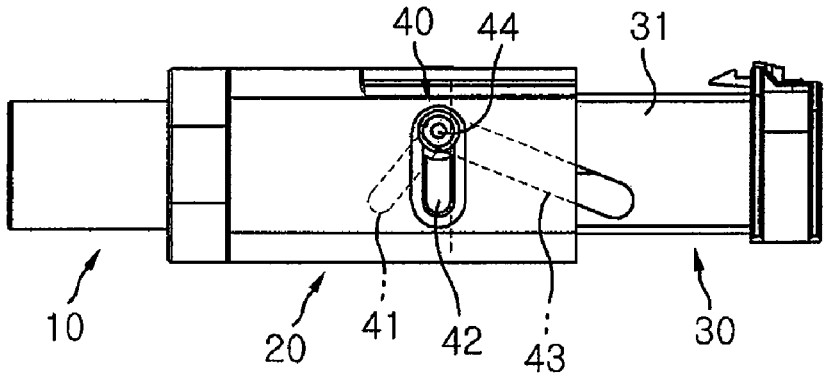
FIG. 4*a* is a side view of the connector of FIG. 1 showing an initial coupling state of a cap and a plug.

The operation state of the connector will now be described in greater detail. First, when the lever 30 is pulled to the outside of the plug 20 at the maximum level before the cap 10 and the plug 20 are coupled to each other, as shown in FIG. 4*a*, the pins 44 move to the upper side of the plug 20 along the operation holes 43 and the guide holes 42. In this state, the pins 44 are blocked by lower surfaces of the operation holes 43 to prevent the pins 44 from being moved down in the guide holes 42. The inner ends of the pins 44 are inserted into the openings formed at the leading ends of the drawing grooves 41 such that the pins 44 can be inserted into the drawing grooves 41.

Figure 4B:
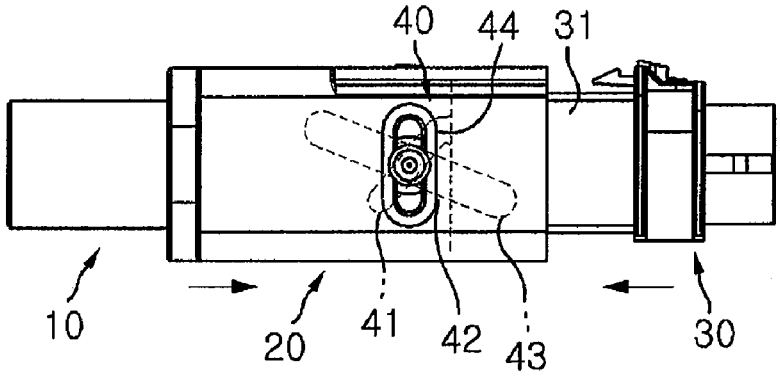
FIG. 4*b* is a side view of the connector of FIG. 1 showing a state in which the cap is being coupled with the plug.

Then, as shown in FIG. 4*b*, when the lever 30 is pushed and inserted into the plug 20, the pins 44 gradually move down along the operation holes 43 and the guide holes 42 while the operation holes 43 of the lever 30 are in contact with the pins 44. At the same time, the pins 44 draw inner surfaces of the drawing grooves 41 formed substantially obliquely downward toward the rear side of the cap 10 such that the cap 10 is drawn into the plug 20.

Figure 4C:
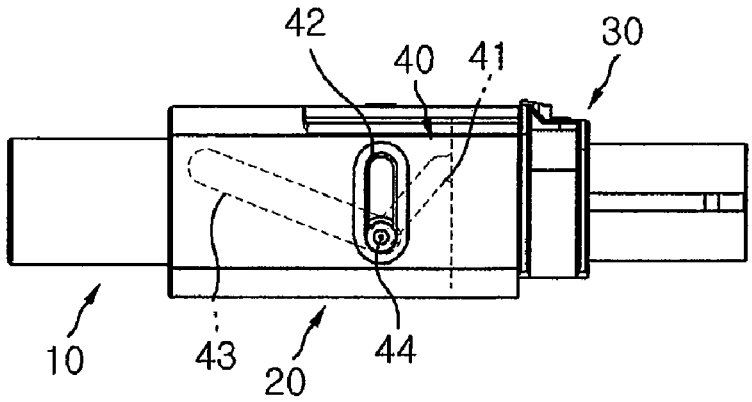
FIG. 4*c* is a side view of the connector of FIG. 1 showing a final coupling state of the cap and the plug.

Then, as shown in FIG. 4*c*, when the lever 30 is completely inserted into the plug 20, the pins 44 completely move down along the operation holes 43 and the guide holes 42 while drawing the inner surfaces of the drawing grooves 41 toward the inner side of the plug 20. Accordingly, the cap 10 is completely drawn into the plug 20, thereby coupling the cap 10 to the plug 20.

On the contrary, in order to separate the cap 10 from the plug 20, when the lever 30 is pulled to the outside of the plug 20 in an order opposite to the above-described order, the pins 44 move up along the operation holes 43 and the guide holes 42. Accordingly, while the inner ends of the pins 44 support the inner surfaces of the drawing grooves 41, the cap 10 is pushed to the outside of the plug 20, thereby separating the cap 10 from the plug 20.

Figure 5A:
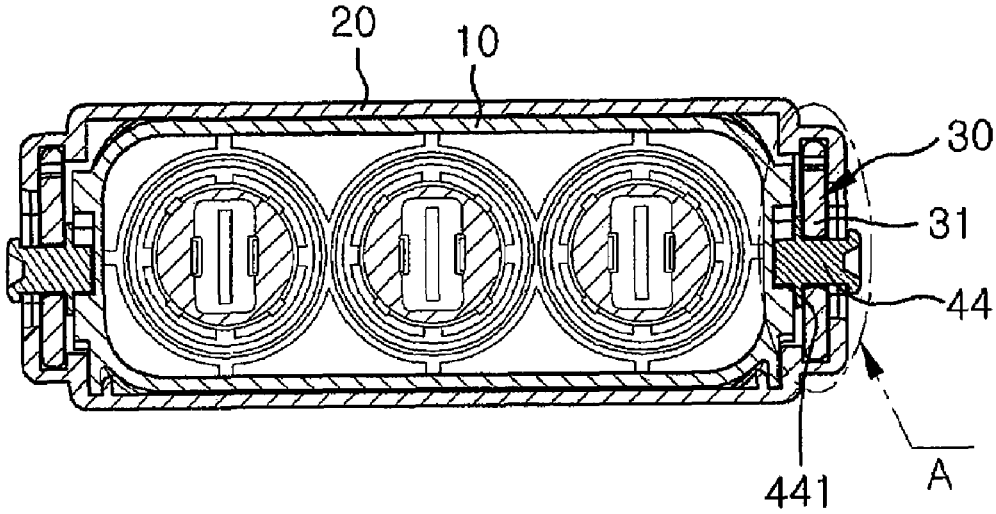
FIG. 5*a* is a longitudinal cross-sectional view of the connector of FIG. 1 showing the final coupling state of the cap and the plug.
Figure 5B:
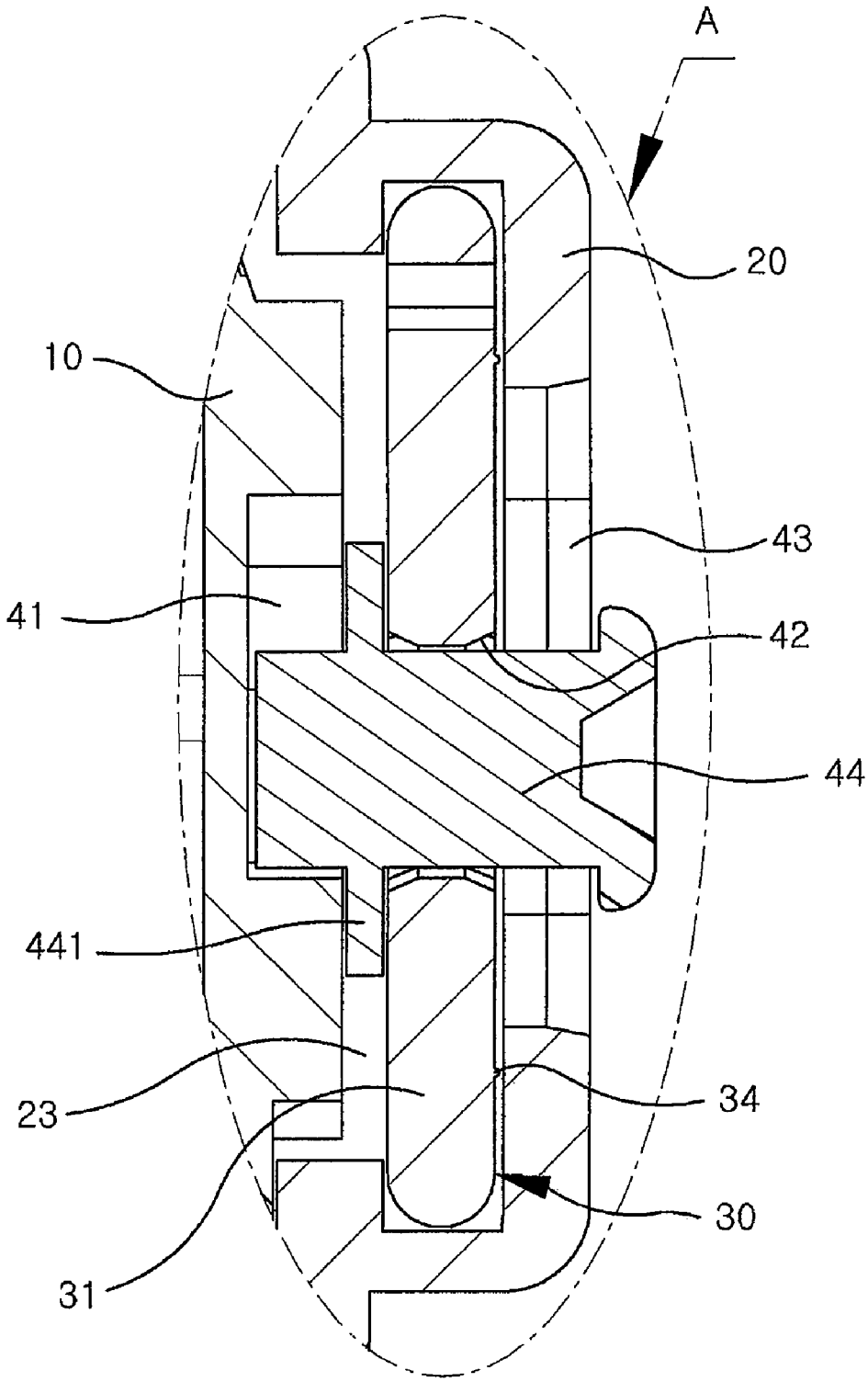
FIG. 5*b* is an enlarged view of a portion indicated by circle A of FIG. 5*a;*

As shown in FIGS. 5*a*-5*b*, the anti-rotation protrusions 441 formed on the outer surfaces of the pins 44 are inserted between the lever 30 and the cap 10. The anti-rotation protrusions 441 support the respective outer surfaces of the lever 30 and the cap 10 while the pins 44 move up and down along the guide holes 42 and the operation holes 43. Accordingly, the pins 44 are substantially perpendicular to the guide holes 42 and the operation holes 43 without being rotated sideward. Consequently, the pins 44 move up and down always substantially perpendicular to the guide holes 42 and the operation holes 43 during the coupling operation of the cap 10 and the plug 20. Thus, the pins 44 can smoothly move up and down. Also, the pins 44 can be disposed at accurate positions in the drawing grooves 41 making it possible to more accurately perform the coupling and separation operation.

As shown in FIG. 5*b*, a main surface of the lever operation pieces 31 can be separated from the inner surfaces of the sliding grooves 23 by the separation protrusions 34, thereby preventing surface contact between the lever operation pieces 31 and the sliding grooves 23. Thus, the separation protrusions 34 minimize a frictional force according to the movement of the lever 30, whereby the lever 30 can move more smoothly.

Figure 6A:
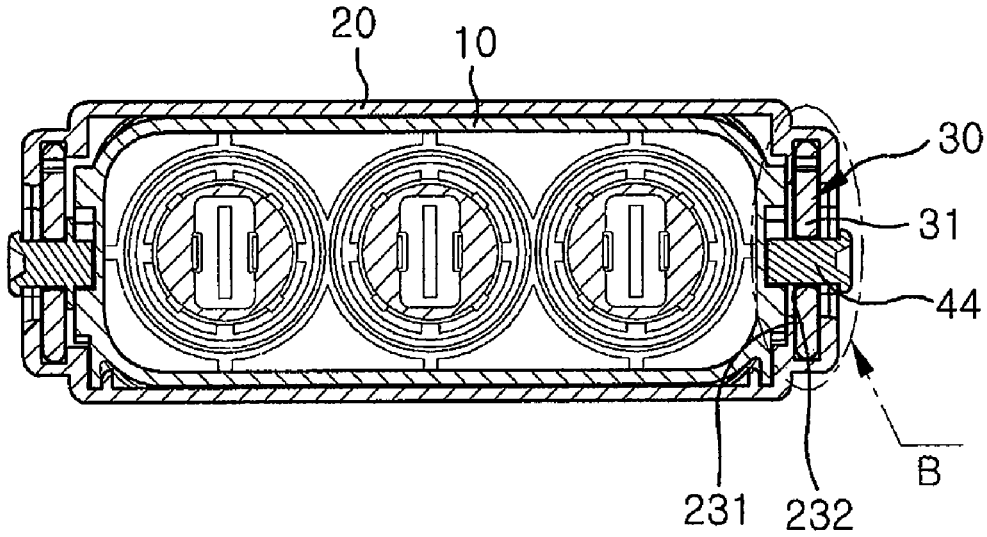
FIG. 6*a* is a longitudinal cross-sectional view of a connector according to a second embodiment of the present invention showing a final coupling state of a cap and a plug.
Figure 6B:
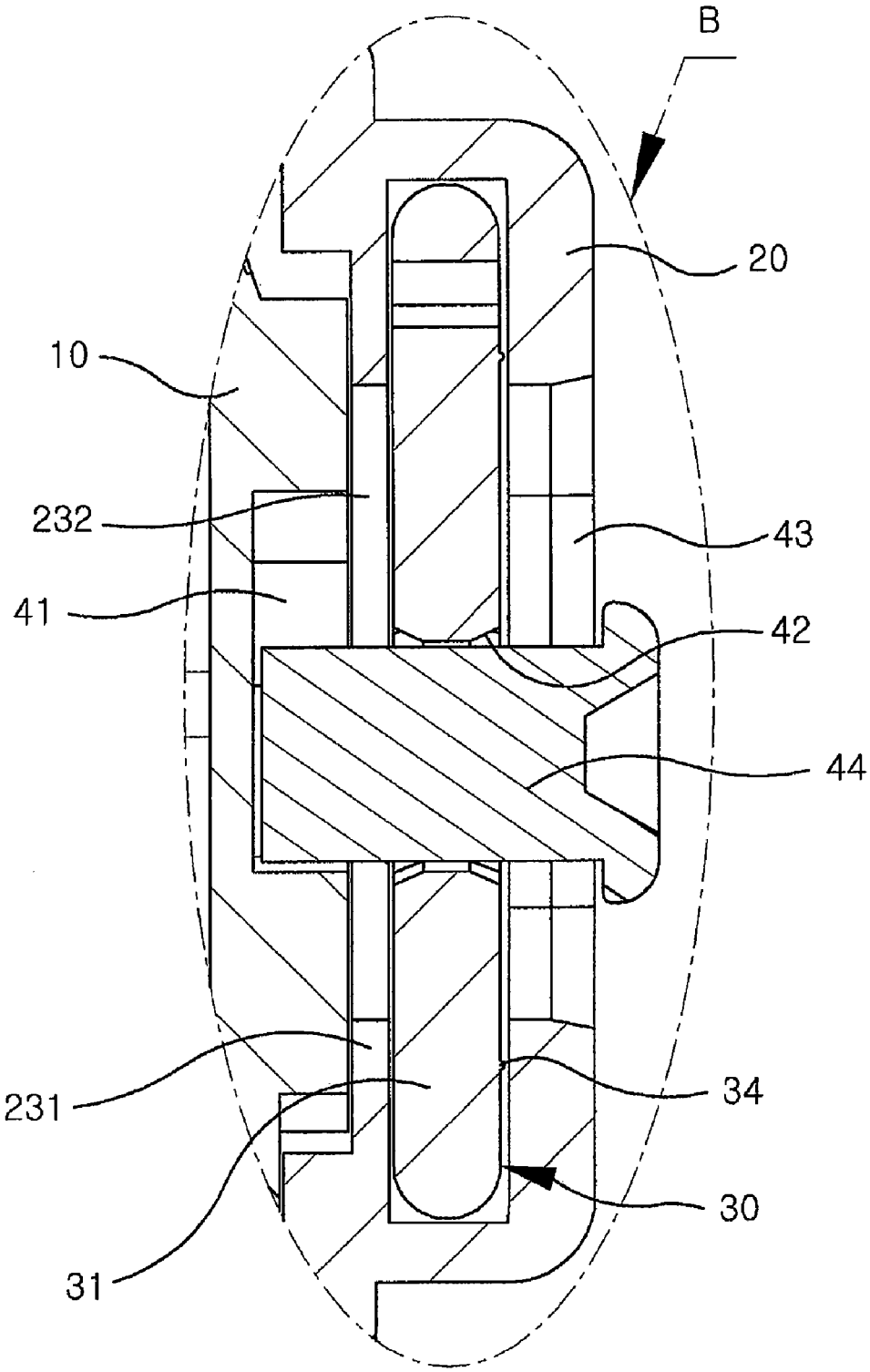
FIG. 6*b* is an enlarged view of a portion indicated by circle B of FIG. 6*a;*

FIGS. 6*a*-6*b* show a connector according to a second embodiment of the present invention. The connector according to the second embodiment of the present invention is identical to the connector according to the first embodiment of the present invention, except that anti-rotation walls 231 and anti-rotation holes 232 are provided instead of the above-described anti-rotation protrusions 441. As shown in FIGS. 6*a*-6*b*, the anti-rotation walls 231 are formed at an inner side of the sliding grooves 23 and are spaced substantially in parallel to an outer wall of the plug 20. The anti-rotation holes 232 that correspond to the operation holes 43 are formed on the anti-rotation walls 231 and pass there through. Accordingly, the pins 44 are prevented from being inclined or rotated sideward and interrupting the coupling operation of the connector without forming the above-described anti-rotation protrusions 441 on the outer surfaces of the pins 44. The anti-rotation walls 231 are spaced from the plug 20 at a distance corresponding to a thickness of the lever operation pieces 31 such that the lever operation pieces 31 can smoothly slide in the plug 20. As the lever 30 moves during the coupling operation of the cap 10 and the plug 20, the pins 44 move along the drawing grooves 41, the guide holes 42, and the operation holes 43, which are formed in different directions. In this case, the pins 44 are prevented from being inclined to perform a more smooth operation.

Figure 7A:
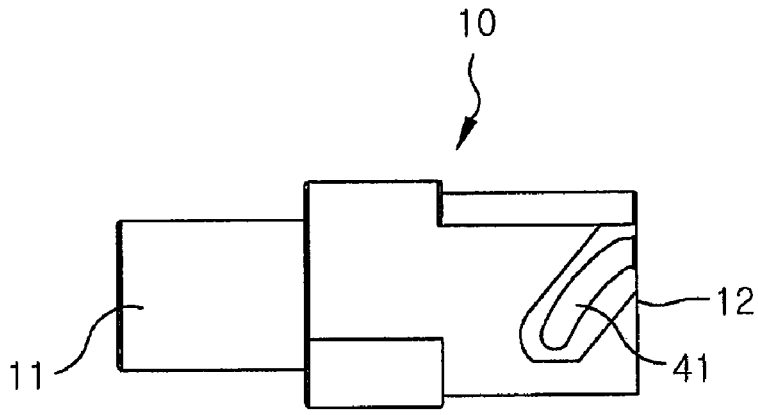
FIG. 7*a* is a side view of a connector according to a third embodiment of the present invention showing a cap having curved drawing grooves.
Figure 7B:
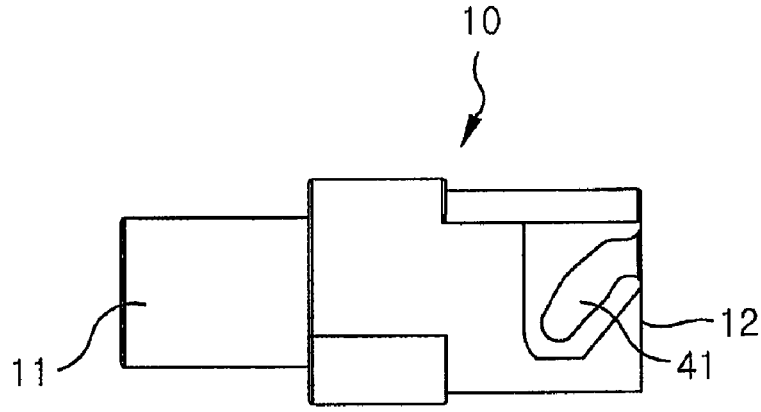
FIG. 7*b* is a side view of a connector according to a fourth embodiment of the present invention showing a cap having multiple inclined drawing grooves.

FIGS. 7*a*-7*b* show a connector according to a third and fourth embodiment of the present invention, respectively. As shown in FIG. 7*a*, the connector according to the third embodiment of the present invention is identical to the connector according to the first embodiment of the present invention, except that the cap 10 has substantially curved drawing grooves 41. As shown in FIG. 7*b*, the connector according to the fourth embodiment of the present invention is identical to the connector according to the first embodiment of the present invention, except that the drawing grooves 41 of the cap 10 has multiple substantially inclined surfaces. The drawing grooves 41 in the connector according to the first embodiment of the present invention are substantially linearly formed obliquely downward toward a rear side such that the pins 44 can smoothly move along the drawing grooves 41. Alternatively, the drawing grooves 41 are formed in a substantially curved shape to be protruded upward, as shown in FIG. 7*a*, or formed to have multiple substantially inclined surfaces with a higher gradient toward the rear side, as shown in FIG. 7*b*, in order to always maintain a uniform force of pushing or pulling the lever 30 during the coupling operation of the cap 10 and the plug 20. Generally, when the cap 10 is coupled to the plug 20, the greatest force is required when the cap 10 and the plug 20 are contacted initially or when the cap 10 and the plug 20 are completely coupled finally. Accordingly, if the pins 44 move along the drawing grooves 41 formed in a substantially curved shape or having multiple substantially inclined surfaces, it is possible to properly disperse the force of operating the lever 30, thereby easily and conveniently coupling the cap 10 to the plug 20.

Figure 8A:
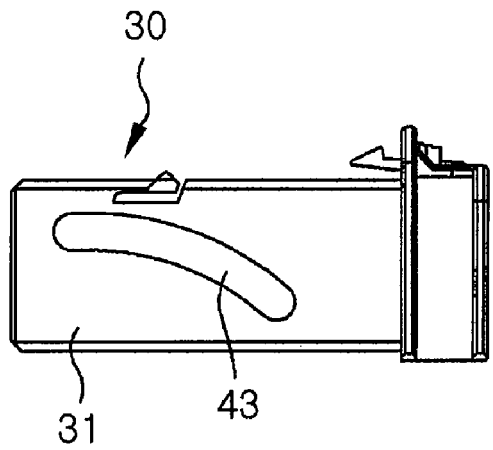
FIG. 8*a* is a side view of a connector according to a fifth embodiment of the present invention showing a lever having curved operation holes.
Figure 8B:
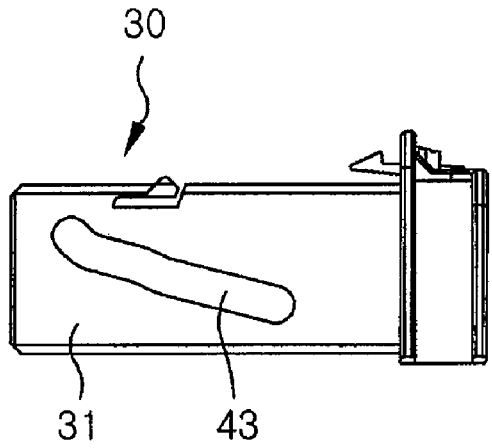
FIG. 8*b* is a side view of a connector according to a sixth embodiment of the present invention showing a lever having multiple inclined operation holes.

FIGS. 8*a*-8*b* show a connector according to a fifth and sixth embodiment of the present invention, respectively. As shown in FIG. 8*a*, the connector according to the fifth embodiment of the present invention is identical to the connector according to the first embodiment of the present invention, except that the lever 30 has substantially curved operation holes 43. As shown in FIG. 8*b*, the connector according to the sixth embodiment of the present invention is identical to the connector according to the first embodiment of the present invention, except that the operation holes 43 of the lever 30 have multiple substantially inclined surfaces. The operation holes 43 in the connector according to the first embodiment of the present invention are substantially linearly formed obliquely downward toward an outside such that the pins 44 can smoothly move along the operation holes 43. Alternatively, the operation holes 43 may be formed in a substantially curved shape to be protruded upward, as shown in FIG. 8*a*, or formed to have multiple substantially inclined surfaces with a higher gradient toward the rear side, as shown in FIG. 8*b*, in order to always maintain a uniform force of pushing or pulling the lever 30 during the coupling operation of the cap 10 and the plug 20. Generally, when the cap 10 is coupled to the plug 20, the greatest force is required when the cap 10 and the plug 20 are contacted initially or when the cap 10 and the plug 20 are completely coupled finally. Accordingly, if the pins 44 move along the operation holes 43 formed in the substantially curved shape or with multiple substantially inclined surfaces, it is possible to properly disperse a force of operating the lever 30, thereby easily and conveniently coupling the cap 10 to the plug 20.

Figure 9:
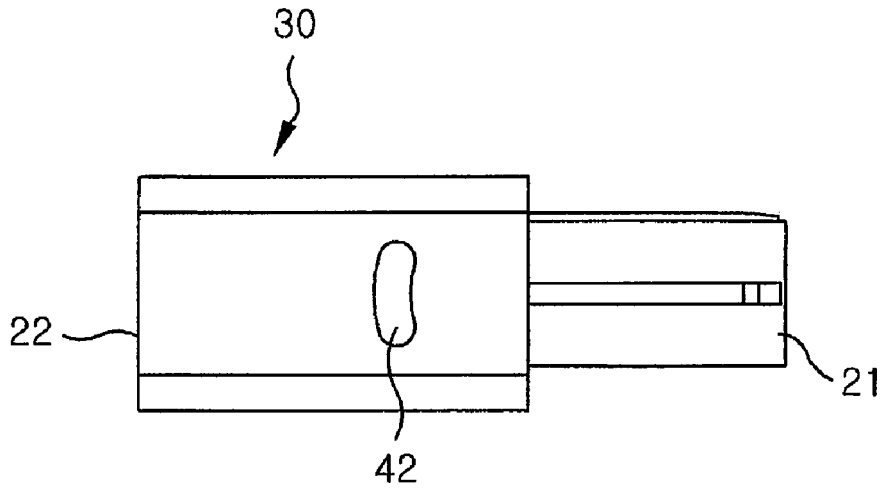
FIG. 9 is a side view of a connector according to a seventh embodiment of the present invention showing a variation of a plug.

FIG. 9 shows a connector according to a seventh embodiment of the present invention. The connector according to the seventh embodiment of the present invention is identical to the connector according to the first embodiment of the present invention, except that the guide holes 42 of the plug 30 are formed in a substantially curved shape to be protruded toward the plug connection port 12 instead of being linearly formed on the plug 20 substantially vertically downward. Thereby, the guide holes 42 always maintain a uniform force of pushing or pulling the lever 30 during the coupling operation of the cap 10 and the plug 20. Generally, when the cap 10 is coupled to the plug 20, the greatest force is required when the cap 10 and the plug 20 are contacted initially or when the cap 10 and the plug 20 are completely coupled finally. Accordingly, if the pins 44 move along the guide holes 42 formed in the substantially curved shape, it is possible to properly disperse a force of operating the lever 30, thereby easily and conveniently coupling the cap 10 to the plug 20.

The connector according to the embodiments described herein includes the lever 30 coupled to the plug 20 and the coupling 40 which couples the cap 10 to the plug 20 by the movement of the lever 30, thereby the cap 10 is easily and conveniently coupled to the plug 20 only by moving the lever 30 in the coupling direction of the connector. Thus, even though the connector is disposed in a small space, the user can perform the coupling and separation operation of the connector with only one hand and the connector can be more conveniently used.

Further, the sliding grooves 23 and the lever operation pieces 31 are formed on the plug 20 and the lever 30, respectively, such that the lever 30 can smoothly slide while the lever 30 is firmly coupled to the plug 20. Thus, it is possible to prevent the lever 30 from being separated from the plug 20 when the lever 30 is operated. Additionally, while the lever 30 moves linearly in the plug 20, the cap 10 is compulsorily moved and connected to the plug 20 by a simple configuration of the coupling 40 having the drawing grooves 41, the guide holes 42, the operation holes 43 and the pins 44. Thus, it is possible to simply manufacture the connector capable of firmly coupling the plug 20 and the lever 30 and smoothly moving the lever 30 in a linear direction.

Also, the engaging projection 32 and the engaging groove 24 are formed to prevent the separation of the cap 10 and the plug 20 in a coupling state. Thus, in various machines and equipment including the connector, it is possible to prevent the separation of the cap 10 and the plug 20 due to vibration or impact, thereby preventing connection from being cut off. Moreover, the current connection can be stably performed. Further, according to the present invention, the click grooves 25 and the click protrusions 33 are formed to check the coupling and separation state of the cap 10 and the plug 20 by a feeling of the lever 30. Thus, the user can accurately perform the coupling and separation operation of the cap 10 and the plug 20 only by a feeling at a small space without directing checking the connector with the naked eye.

Also, the anti-rotation protrusions 441 are formed on the outer surfaces of the pins 44 to prevent the pins 44 from being rotated sideward at the inner side of the drawing grooves 41, the guide holes 42, and the operation holes 43. Thus, the pins 44 can be always substantially perpendicular to the sidewalls of the plug 20 and the lever 30, thereby softly and smoothly moving the lever 30 and also smoothly performing the coupling operation of the cap 10 and the plug 20. Additionally, the separation protrusions 34 are formed to prevent the lever 30 from being in close contact with the sliding grooves 23. Thus, it is possible to minimize a frictional force generated according to the movement of the lever 30, whereby the lever 30 can move more smoothly in a linear direction. Also, it is possible to reduce a force required for coupling the cap 10 to the plug 20.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A connector, comprising:

a cap detachably coupled to a plug in a coupling direction, the cap and the plug being electrically connected to each other;

a lever coupled to the plug, the lever being moveable linearly in a direction the same as the coupling direction; and a coupling actuated by the linear movement of the lever that draws and compulsorily presses the cap into the plug in the coupling direction to couple the cap and the plug.

2. The connector of claim 1, wherein the plug includes an engaging groove and the lever includes an engaging projection that fix the lever to the plug when the cap and the plug are coupled.

3. The connector of claim 1, wherein the plug has sliding grooves formed on opposite sides thereof and the lever has lever operation pieces formed on opposite sides thereof that are received in the sliding grooves.

4. The connector of claim 3, wherein the lever operation pieces have separation protrusions that separate an inner surface of the sliding grooves from a main surface of the lever operation pieces to minimize friction there between.

5. The connector of claim 3, wherein click grooves are formed at inner sides of the sliding grooves and correspond to maximum insertion and separation positions of the lever and click protrusions are formed on outer surfaces of the lever operation pieces.

6. The connector of claim 1, wherein the coupling includes at least one drawing groove formed on a side surface of the cap, at least one guide hole formed on a side surface of the plug, at least operation hole formed on a side surface of the lever, and at least one pin that extends through the drawing groove, the guide hole, and the operation hole that guides the coupling of the cap and the plug.

7. The connector of claim 6, wherein the pin includes an anti-rotation protrusion arranged between the lever and the cap that guides the pin.

8. The connector of claim 6, wherein the plug has at least one anti-rotation wall extending substantially parallel to an outer wall of the plug that guides the pin.

9. The connector of claim 6, wherein the guide hole extends in a direction substantially perpendicular to the coupling direction, the drawing groove and the operation hole extend substantially obliquely to the coupling direction, and the drawing groove and the operation hole extend in opposite directions.

10. The connector of claim 9, wherein the drawing groove is open toward a side of the plug.

11. The connector of claim 9, wherein the drawing groove has a substantially curved shape.

12. The connector of claim 9, wherein the drawing groove has multiple substantially inclined surfaces.

13. The connector of claim 9, wherein the operation hole has a substantially curved shape.

14. The connector of claim 9, wherein the operation hole has multiple substantially inclined surfaces.

15. The connector of claim 9, wherein the guide hole has a substantially curved shape.

* * * * *